US005559543A

United States Patent [19]

Komuro

[11] Patent Number: 5,559,543

[45] Date of Patent: Sep. 24, 1996

[54] METHOD OF MAKING UNIFORMLY PRINTING INK JET RECORDING HEAD

[75] Inventor: Hirokazu Komuro, Yokohama, Japan

[73] Assignee: Canon Kabushiki Kaisha, Tokyo, Japan

[21] Appl. No.: 252,391

[22] Filed: Jun. 1, 1994

Related U.S. Application Data

[63] Continuation of Ser. No. 867,079, Apr. 14, 1992, abandoned, which is a continuation of Ser. No. 700,056, May 8, 1991, abandoned, which is a continuation of Ser. No. 486,855, Mar. 1, 1990, abandoned.

[30] Foreign Application Priority Data

Mar. 1, 1989 [JP] Japan ..... 1-48841
Mar. 1, 1989 [JP] Japan ..... 1-48842

[51] Int. Cl.[6] ..... B41J 2/05

[52] U.S. Cl. ..... 347/62; 29/610.1; 216/16; 216/27; 338/195; 338/308

[58] Field of Search ..... 347/62, 57, 42, 347/13, 12, 206, 208; 338/308, 195, 89; 427/101, 102; 29/610.1, 611, 620; 216/27, 16, 41

[56] References Cited

U.S. PATENT DOCUMENTS

| | | | |
|---|---|---|---|
| 3,095,340 | 6/1963 | Triller . | |
| 3,441,804 | 4/1969 | Klemmer | 338/308 X |
| 4,313,124 | 1/1982 | Hara . | |
| 4,334,234 | 6/1982 | Shirato et al. . | |
| 4,485,370 | 11/1984 | Poisel | 338/195 X |
| 4,560,583 | 12/1985 | Moksuold | 427/101 X |
| 4,560,997 | 12/1985 | Sato et al. . | |
| 4,567,493 | 1/1986 | Ikeda | 347/64 |
| 4,604,654 | 8/1986 | Sakurada et al. . | |
| 4,612,554 | 9/1986 | Poleshuk . | |
| 4,631,578 | 12/1986 | Sasaki et al. . | |
| 4,635,078 | 1/1987 | Sakurada et al. . | |
| 4,672,432 | 1/1987 | Sakurada et al. . | |
| 4,679,931 | 7/1987 | Sueda et al. . | |
| 4,682,216 | 7/1987 | Sasaki et al. . | |
| 4,692,773 | 9/1987 | Saito et al. . | |
| 4,713,746 | 12/1987 | Watanabe et al. . | |
| 4,723,129 | 2/1988 | Endo | 347/56 |
| 4,727,436 | 2/1988 | Kawamura et al. . | |
| 4,738,871 | 4/1988 | Watanabe . | |
| 4,740,800 | 4/1988 | Kyoshima . | |
| 4,772,867 | 9/1988 | Rosner | 338/308 |
| 4,772,911 | 9/1988 | Sasaki et al. . | |
| 4,782,202 | 11/1988 | Sawae | 29/610.1 X |
| 4,959,659 | 9/1990 | Sasaki et al. . | |

FOREIGN PATENT DOCUMENTS

| | | | |
|---|---|---|---|
| 3012946 | 10/1980 | Germany | B05B 1/00 |
| 7361 | 1/1983 | Japan | B41J 3/04 |
| 60-297217 | 7/1987 | Japan . | |
| 61-31807 | 8/1987 | Japan . | |

OTHER PUBLICATIONS

Official Search Report for Eur. Patent App. No. 90302142.6.

*Primary Examiner*—Joseph W. Hartary
*Attorney, Agent, or Firm*—Fitzpatrick, Cella, Harper & Scinto

[57] ABSTRACT

The present invention concerns a thermal recording apparatus, preferably an ink jet thermal recording device and, a process for forming the same and, accomplishes uniformized heat energy action of the heat acting surface (a protective layer surface when there is protective layer), namely the heat-generating resistors of a plurality of electrothermal transducers. The present invention has uniformized the amount of heat energy generated during recording at the heat acting portions by positively changing the shape or the thickness of the resistors concerned with the heat acing portions or/and the constitution itself of the protective layer depending on its existing position.

9 Claims, 10 Drawing Sheets

METHOD OF MAKING UNIFORMLY PRINTING INK JET RECORDING HEAD

This application is a continuation of application Ser. No. 07/867,079 filed Apr. 14, 1992 abandoned, which is a continuation of application Ser. No. 07/700,056 filed May 8, 1991 abandoned which is continuation of application Ser. No. 07/486,855 filed Mar. 1, 1990 abandoned.

BACKGROUND OF THE INVENTION

1. Field of the Invention

This invention relates to the construction of a substrate of a thermal recording head having a heat-generating resistance layer, a recording head having this substrate and further, a process for producing these, and a recording apparatus by use of these.

The present invention concerns a substrate for use in a liquid jet recording head which records images by causing a state change involving the formation of bubbles in a liquid by adding heat energy. This causes the liquid to be discharged through a discharge port to form flying droplets, which impinge on the surface to be recorded. A head for liquid jet recording is constructed using this substrate, and is suitable particularly for the multi-integration type liquid jet recording head.

The present invention is effective for use in thermal recording heads incorporated in printers, copying machines, facsimile machines, computer output instruments, etc.

2. Related Background Art

In the field of thermal recording methods, an effective substitute for thermal print (impact) method is the ink jet recording method, which as a non-impact method has recently attracted attention and has been practically applied.

All of the liquid jet recording methods described in, for example, Japanese Laid-open Patent Application No. 54-51837, and German Laid-Open Patent Application (DOLS) No. 2843064 have a specific feature different from other liquid jet recording methods in that the power source for causing droplet discharge is thermal energy, which is applied to the liquid.

More specifically, according to the recording method disclosed in the above-mentioned published specifications, the heated liquid undergoes a state charge accompanied by an abrupt increase of volume, and because of this state change, droplets are discharged and expelled through the discharge opening provided at the tip of the recording head to be printed on a recording medium material, thereby effecting recording of information.

The liquid recording method disclosed in DOLS No. 2843064, and U.S. Pat. Nos. 4,723,129 and 4,740,796 can be effectively applied to the so called drop-on demand recording method, but in addition the recording head can be easily designed with high density multi-discharge ports across its full line width, and therefore it has the advantage that high resolution images and high quality can be obtained at high speed.

The ink jet recording head based on such principle applies a voltage to the heat-generating resistor (heater) of the heat acting portion, and the resulting state change includes the formation of bubbles (the above-mentioned one discloses the preferable form of film boiling) on the heat acting surface, which acts on ink by the heat energy generated thereby, and the ink is expelled through the discharge opening by the the state change giving rise to such foaming.

When the voltage is increased from zero level, foaming is initiated at a certain definite voltage. This certain voltage is important, and hereinafter is called the foaming voltage.

For discharging ink, a voltage greater than this foaming voltage (driving voltage) must be applied. Also, for improving printing quality, the driving voltage must be made higher than the foaming voltage, to some extent, while for improving pulse durability, the driving voltage must be minimized. The optimum value of those applied voltages has been standardized as corresponding to some multiple of the foaming voltage. Therefore, it is a very great factor in realizing improvement of printing quality, etc. how the foaming voltage which becomes the standard should be set.

More specifically, in order to obtain a uniform discharging characteristic/printing characteristic within the recording head, and also to improve discharging durability, it may be considered that the foaming voltage within the recording head should be always constant.

Whereas, for preparation of a thermal recording head, in which a plurality of heat-generating resistors, electrode pairs corresponding thereto and insullating protective layers are formed, film forming technique is practiced, but the problem of variations in the structure of the respective parts has occured in bulk production or from lot to lot. In practical application, in spite of these variations, the heat energy needed for ink discharge has been reliably provided by giving foaming voltage itself relatively over to great extent to the respective heat-generating resistors.

However, variations in electrothermal transducers including the respective resistors, electrodes and optional insulating layers become obstacles in improving printing precision.

One solution to this problem is the invention of Japanese Patent Application No. 60-297217 (Japanese Laid-open Patent Application No. 62-152863) filed by Canon K. K. as Applicant. This invention calls attention to the fact that all of the resistance layers, insulating layers, and electrodes become thinner at the both end regions as compared with the central region of the recording head when formed by sputtering, and has clarified that an electrothermal transducer with uniformized thickness can be obtained at the portions of concentric shapes. In this invention, since the range with relatively smaller variance is selected in the region to be formed into film, the electrothermal transducer cannot only accomplish linear higher densification, but also due to the difference of the recording gaps relative to the recording medium from each other, the whole recording must be uniformized by further control. Also, in this invention, it is difficult to obtain a full-line thermal head.

On the other hand, although U.S. Pat. No. 4,740,800 clearly describes that the width of the heat-generating resistance layer formed by etching is greatly varied, it only discloses as a solution that the center side with relatively less variance is used for recording without use of the heat-generating resistance layer on both end sides. Therefore, according to this invention, the recording head is enlarged, as will be the device. Of course, this invention may be practical for a recording head having less than a hundred and twenty-four, electrothermal transducers because no much enlargement is brought about, and is actually used. Anyway, for limited use of the range with relatively less variations, secondary control means for such variations is required, and the variations become greater in the case of one thousand or more electrothermal transducers formed into a full line.

Thus, in the prior art, because there has been no fundamental solution of the problems in production of thermal head, recording has been performed by selecting electrothermal transducers with relatively smaller variations.

SUMMARY OF THE INVENTION

A principal object of the present invention is to provide a thermal recording head which can better uniformize the characteristics of an electrothermal transducer produced than the prior art, thereby making the amount of heat generated uniform even with a substantially constant voltage applied, and consequently lowering the stabilization coefficient for the foaming initiation potential, as well as a substrate therefor, a method for production thereof, and further a recording method which can perform stable recording for a long term with high image quality by use thereof.

Initiation of foaming depends on the power charged per unit area of the heat-generating portion (hereinafter called a heater). And, when the heater area is the same, the foaming initiation power is constant, and therefore the foaming voltage depends on the resistance value of the heat-generating resistance layer, namely the sheet resistance of the heat-generating resistance layer and the pattern shape (dimensions) of the heater (here, sheet resistance refers to specific resistance/layer thickness).

In the case of full-multi integration heads of A4 and A3 widths according to the of Japanese Industrial Standard, the sheet resistance as mentioned above may sometimes be uniform within the recording head. This effect is particularly marked when the sputtering method is employed to prepare the heat-generating resistance layer. More specifically, if the target is small in the sputtering method, a large layer thickness distribution (layer thickness change) is generated. Accordingly, when the layer thickness distribution is reduced, the target must be made larger, whereby the recording apparatus as a whole becomes larger. And, if the device becomes larger, the production cost of the device becomes higher.

Therefore, when preparing a recording head with constant foaming voltage within the recording head, particularly a full-multi type liquid jet recording head of high quality and durability the production cost of the recording head can become very high. On the contrary, preparing an inexpensive full-multi integration type liquid jet recording head, the performance of the recording head as a whole was lowered, with poor durability of some segments or poor printing characteristics.

Another object of the present invention, in view of the problems as described above, is to provide a small scale and inexpensive substrate for liquid jet recording heads having high printing quality and high durability without being nonuniformly influenced by the sheet resistance of the heat-generating resistance layer, and a liquid jet recording head using this substrate, and a method for producing the substrate.

Particularly, even in the case of using an upper layer as the protective layer on the heat-generating resistance layer surface within the recording head, in order to obtain uniform discharge and printing, characteristics, and also to increase discharge durability, it may be considered that the foaming voltage within the recording head should be kept constantly stable. Initiation of foaming depends on the heat energy generated per unit area in the heat acting surface which is the foaming surface, and the value of the heat energy is a constant value. When the heat energy (power) generated by the heat-generating resistor to the heat acting portion within the path is constant, the foaming initiation heat energy depends on the thermal barrier amount of the upper protective layer between the foaming surface and the heat-generating resistor, namely its layer thickness.

When the upper protective layer is prepared by sputtering, the problem of nonuniformity is particularly noticeable, as described above. More specifically, if the sputtering target is small, a large film thickness distribution will be generated. Accordingly, if the film thickness distribution is to be reduced, the target must be made larger, whereby the size of the recording apparatus as a whole increase. If the device becomes larger, the production cost of the device becomes higher.

Still another object of the present invention, in view of the above problems, is to provide a small and inexpensive liquid jet recording head having high printing quality and high durability without being nonuniformly influenced by the layer thickness of the upper protective layer, and a method for producing the same.

The present invention, differs from the prior art in that the respective constitutions have been positively changed so that the heat energy may be made substantially uniform in either of a plurality of resistors or electrothermal transducers. That is, it is specific in that the actions are positively compensated by making the protective layer of a plurality of resistors or electrothermal transducers larger at both end sides than in the central region, thereby giving substantially uniform heat energy in response to a substantially uniform applied voltage.

To accomplish this object, a representative substrate of the present invention has a support, a heat-generating resistance layer and a plurality of electrothermal transducers formed on the support, having a pair of electrodes connected to the heat-generating resistance layer, characterized in that the plurality of heat-generating portions of the heat-generating resistance layer comprising the portions positioned between the pair of electrodes are formed with varied dimensions so that the resistance values may be substantially equal to each other corresponding to the respective sheet resistances.

Also, the representative substrate of the present invention is characterized in that the plurality of heat-generating portions are all rectangular, and the areas of the rectangular portions are substantially equal to each other, and the dimensions are varied by charging the ratio of the lengths of the sides of the rectangular portions.

Also, the representative recording head of the present invention is formed using the substrate for liquid jet recording head described above, and is characterized in that liquid is discharged from the discharge port by utilizing the heat energy generated by the electrothermal transducer, and said discharge port is provided in a number corresponding to the recording width of the recording medium member.

Also, the present invention provides a process for producing a substrate for liquid jet recording head, having a heat-generating resistance layer and a plurality of electrothermal transducers having a pair of electrodes connected to the heat-generating resistance layer, by measuring previously the respective sheet resistances of the plurality of heat-generating portions comprising the portions of the heat-generating layer positioned between the pair of electrodes, and forming the heat-generating portions with varied dimensions of the plurality of heat-generating portions so that the resistance values may be substantially equal to each other corresponding to the respective sheet resistances measured.

The present invention, with the respective constitutions as specified above, has been made to form the heat-generating portions with varied dimensions of a plurality of heat-generating portions so that the resistance values may be substantially equal to each other corresponding to the sheet resistance of the heat-generating resistance layer, and therefore can prepare a full-multi integration type liquid jet recording head of widths such as A4 width, A3 width, etc. which offers good pulse durability as well as printing quality by means of an inexpensive film forming device, and also can reduce production cost of the recording head.

For accomplishing such another object, another representative constitution of the present invention has a support, a plurality of electrothermal transducers formed on the support, having a heat-generating resistance layer and a pair of electrodes connected to the heat-generating resistance layer, and an upper layer formed on the plurality of electrothermal transducers for protection of the plurality of electrothermal transducers, characterized in that liquid paths communicated to the discharge ports for discharging liquid corresponding to the heat-generating portions for generating heat energy for discharging liquid comprising the portions of the heat-generating layer positioned between the pair of electrodes are provided, and the heat-generating portions are formed with varied dimensions so that the foaming voltages may become substantially equal to each other corresponding to the layer thickness of the upper layer.

Also, the present invention is characterized in that the plurality of heat-generating portions are all rectangular, the areas of the rectangular portions are substantially equal to each other, and the dimensions are varied by varying the ratio of the lengths of the sides of the rectangular portions.

Also, another preferable invention is a process for producing a liquid jet recording head having a support, a plurality of electrothermal transducers formed on the support, having a heat-generating resistance layer and a pair of electrodes connected to the heat-generating resistance layer, and an upper layer formed on the plurality of electrothermal transducers for protection of the plurality of electrothermal transducers, provided with liquid paths communicated to the discharge ports for discharging liquid corresponding to the heat-generating portions for generating heat energy for discharging liquid comprising the portions of the heat-generating layer positioned between the pair of electrodes, by measuring previously the change in layer thickness of the upper layer, and forming the heat-generating portions with respective varied dimensions so that the foaming voltages within the recording head may become substantially constant with each other corresponding to the layer thickness data of the upper layer as measured.

With the constitution as specified above, the heat-generating portions have been made to be formed with varied dimensions so that the foaming voltages may be substantially equal in all the segments corresponding to the layer thickness (film thickness change) of the upper layer formed on the electrothermal transducers, and therefore a full-multi integration type liquid jet recording head of A4 width, A3 width, etc. having good pulse durability as well as good printing quality can be prepared, and also lowering the production cost of the recording head together with quality improvement.

The present invention is also effective for the case when the heat acting surface itself is a resistor without an upper protective layer, and when the heat acting surface is a protective layer, either of the dimensions of the above resistor or the above protective layer may be practiced, but use of both in combination is also included within the present invention.

DESCRIPTION OF THE PREFERRED EMBODIMENTS

Figure 4A:
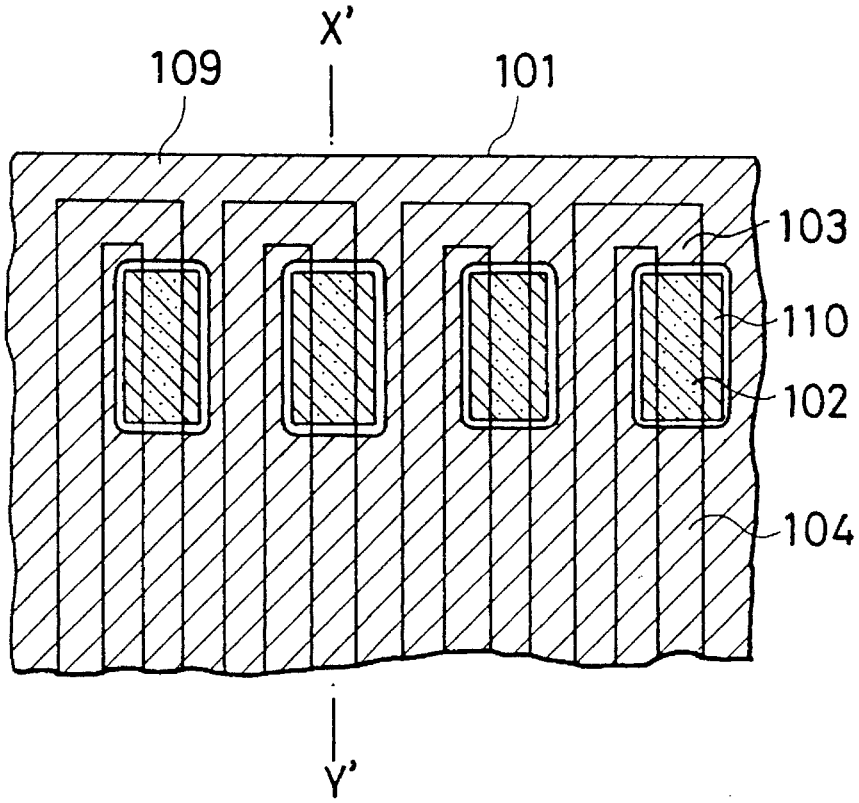
FIG. 4A is a plan view showing the constitution of the substrate of an example of the present invention.
Figure 4B:
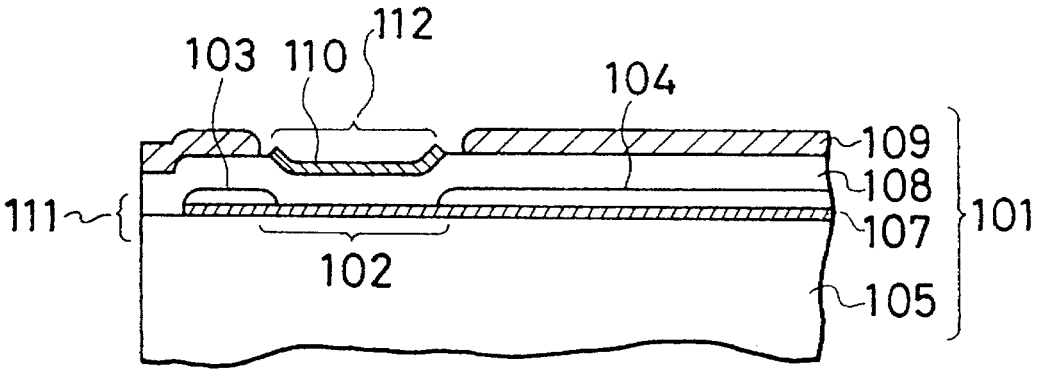
FIG. 4B is a sectional view showing the constitution of the substrate of an example of the present invention.

FIGS. 4A and 4B show structural examples of typical head substrates of the prior art of the liquid jet recording heads according to the bubble jet recording system. FIG. 4A is a plan view of a substrate in which a heat-generating portion is arranged within a liquid path of ink (recording liquid) communicated to the discharge port, and FIG. 4B is a sectional view along the cut line of X'- Y' in FIG. 4A.

Here, 101 is the whole substrate, 102 the heating portion positioned within the wall surface of liquid path communicated to the discharge port for discharging ink for generating bubbles by heating the ink (called heater), 103, 104 are a pair of leader electrodes made of aluminum connected to the heat-generating resistance layer 107 for applying a predetermined voltage on the heat-generating portion 102, 105 a support made of Si (silicon), and 107 a heat-generating resistance layer formed by laminated on the support 105. The heat-generating portion 102 is the portion positioned between the pair of electrodes 103, 104.

108 is a first upper protective layer (made of $SiO_2$) which protects the leader electrodes 103, 104, etc. by covering wholly thereover, 109 a third upper protective layer of the ink contact surface which further protects most of the first upper protective layer 108, and 110 a second upper protective layer which protects the portion where the heat-generating portion 102 exists. 111 is an electrothermal transducer comprising electrodes 103, 104 and a heat-generating resistance layer 107. 112 is a foaming surface which is the surface of the upper protective layer 110 corresponding to the heat-generating portion 102, and bubbles are generated on this surface.

The liquid jet recording head based on such principle is actuated by applying a voltage to the heating portion (heater) 102 of the heat-generating portion 111, generating bubbles on the foaming surface 112 of the second upper protective layer 110 by the heat energy generated thereby, and discharging the ink through the discharge port by the force generated by such foaming.

A. Basic principle of the invention

Before explanation of specific examples of the present invention, the basic principle of the present invention is to be described in detail.

That is, the problems as described in the prior art example have been solved, because the recording head is prepared so that the pattern design with various dimensions of the heat-generating portion heater is chosen so that the resistance values may be substantially the same corresponding to the distribution characteristic of sheet resistances (=specific resistance/layer thickness) of the heat-generating resistance layer.

To describe in detail below, in the case when the sheet resistance at the both ends is 15 Ω, and the sheet resistance at the central portion 20 Ω in a full-multi integration type liquid jet recording head with A4 width, the dimensions of the heater (heat-generating portion) at the central portion are designed as 20 μm×100 μm, and the dimensions of the heaters at both ends as 17 μm×115 μm. When thus designed, the resistance values become:

20×100/20=100Ω at the central portion, and

15×115/17=101Ω at the both end portions, both becoming substantially the same.

Here, the heater should be designed in view of the area of the heater. More specifically, in a recording head of the bubble jet recording system utilizing the bubbles expanded with abrupt gasification of ink by heat generation of the heater, the heater area becomes an important factor in bubble generation. The size of the heater area, affects the foaming volume, and therefore if the heater area is made smaller, the foaming volume becomes smaller, while if it is made larger, the foaming volume becomes larger. On the other hand, since the discharge volume of ink depends greatly on the foaming volume, the discharge volume will vary according to the heater area. Accordingly, printing quality is greatly affected by uniformity of discharge volume, and therefore it is important to make the heater area uniform as a whole.

By making the heater area the same, the heaters at the central portion and both ends have the same resistance values, whereby the foaming voltage becomes the same in all the segments. Thus, if the heat-generating portions of the central portion and both ends have the same area and the same foaming voltage, by setting adequate driving voltage values with good pulse durability as well as good printing characteristic, all the segments from the central portion to both ends can be driven under the same conditions. By doing so, it is possible to prepare a recording head with all the segments having the whole (total) performance as the recording head, particularly the balance of printing characteristic/durability.

While the sheet resistance of the central portion and both ends is described above, it is practically necessary to vary the design pattern of the heater according to the distribution of the whole sheet resistance.

Next, heater resistance and design of dimensions of the heater are to be described. For brevity of explanation, the heater is made rectangular.

First, the sheet resistance distribution can be shown as a function f(x) of the distance x from an end of the sheet.

Now, if the dimension in the longer direction of the heater is defined as l, and the dimension in the shorter direction as m, the heater resistance h is given by the following formula (1):

$$h=f(x)\times l/m \tag{1}$$

If the area of the heater is defined as s, the heater area $_s$ is constant and therefore represented by the following formula:

$$s=l\times m$$

$$l=s/m \tag{2}$$

From the above formula (2) and the above formula (1), the following formula (3) is derived $$h=f(x)\times\frac{\frac{s}{m}}{m}=f(x)\times\frac{s}{m^2}$$

$$m^2=f(x)\times\frac{s}{h} \tag{3}$$

Hence, $$m=\sqrt{s/h\times f(x)}\ . \tag{4}$$

Therefore, if the heater resistance h, the heater area s and the distribution data f(x) of the sheet resistance are given, the design of the heater follows according to the above formulae (4) and (2). Specific examples are described below.

B. First example

FIG. 1 to FIG. 5 show an example of the present invention.

First, as shown in FIG. 4A, 4B, a heat-generating resistance layer 107 of $HfB_2$is formed on a silicon support (also known as a glass substrate) by a RF (high frequency) sputtering method. The layer thickness distribution of the heat-generating layer 107, as shown by curve of the chain line in FIG. 2, exhibited a tendency that both ends were thick, and the central portion was thin with A4 size width. It has been found that the layer thickness (film thickness) distribution of the film forming device has constantly the same tendency. Therefore, it is possible that the layer may have a layer thickness distribution characteristic opposite to this if the film forming device is changed.

Figure 1:
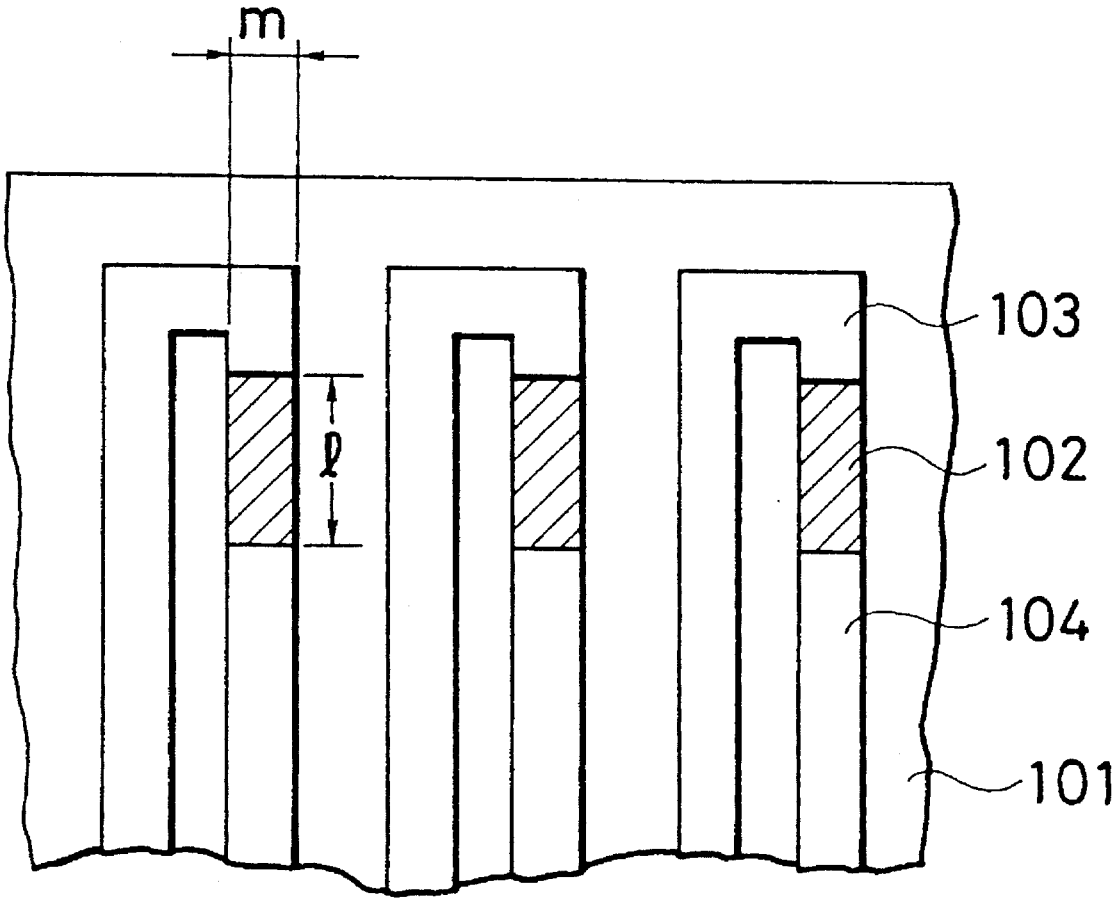
FIG. 1 is a plan view showing the substrate of an example of the present invention.
Figure 2:
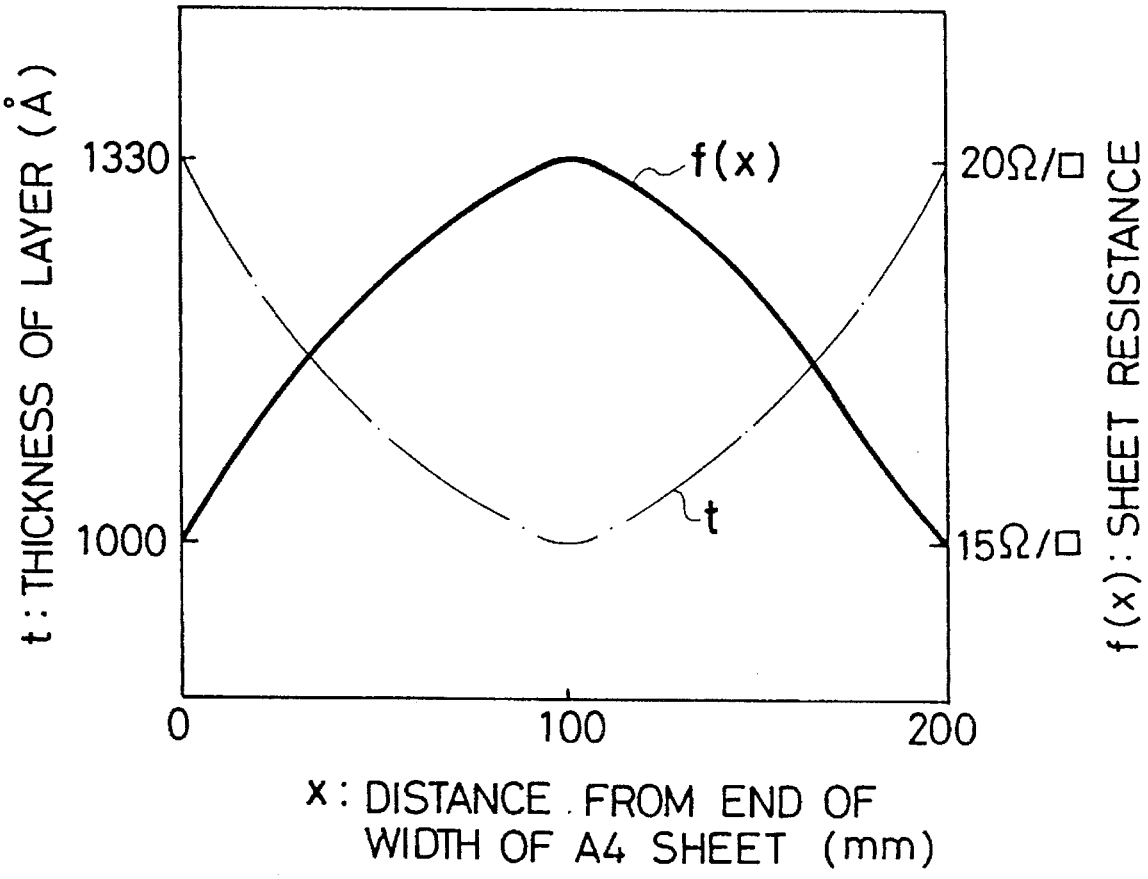
FIG. 2 is a distribution diagram showing an example of the distribution of layer thicknesses and sheet resistances of the heat-generating resistance layer of an example of the present invention.

The sheet resistance distribution of the heat-generating resistance layer 107 of $HfB_2$ as is shown by the solid line in FIG. 2. When calculation was performed by substituting the values of s=2000 $\mu m^2$, h=100Ω in the above formula (4) of $m=\sqrt{s/h\times f(x)}$ for the heat-generating resistance layer 107 having such sheet resistance distribution, the values of m and l took on the relationship as shown in FIG. 3.

Figure 3:
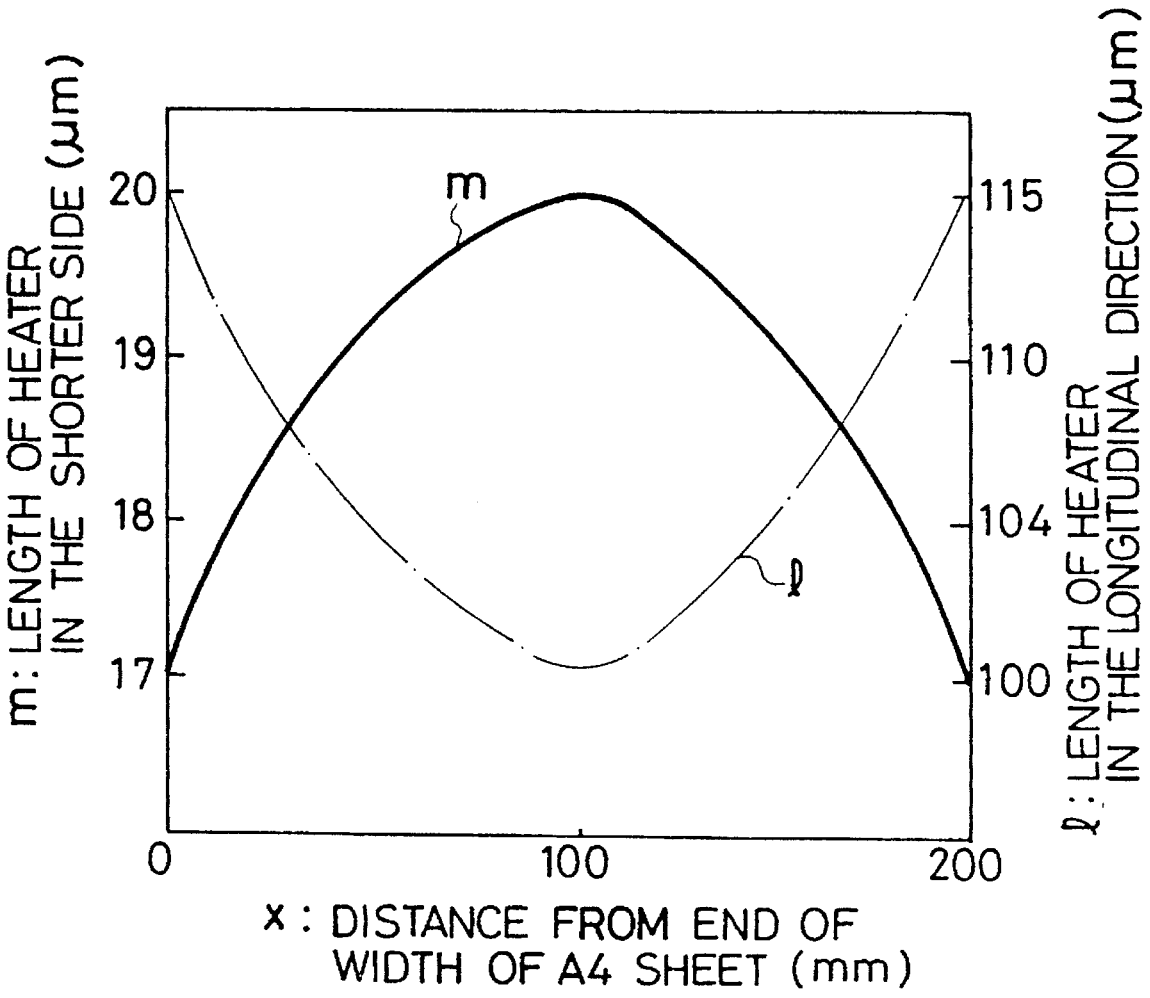
FIG. 3 is a diagram showing an example of the heater design dimensions.

Accordingly, a photomask was prepared to form a heater so as to satisfy the relationship in FIG. 3. Aluminum was vapor deposited to a thickness of 5000 Å on the heat-generating resistance layer 107 as electrode materials 103, 104, and then a rectangular heater (heat-generating portion) 102 was formed according to the photolithographic technique using of the photomask as described above (see FIG. 1). When the dimensions of the heater 102 were measured, the dimensional relationship shown in FIG. 3 was obtained.

Next, the first upper protective layer 108, made of $SiO_2$ (silicon oxide) was prepared with a thickness of 1 μm RF sputtering.

Further, for the second protective layer 110, a Ta (tantalum) film was formed with a thickness of 0.5 μm, and then was subjected to patterning by the photolithographic technique only around the heater 102, and $SiO_2$ 108 was subjected to patterning by opening thru-holes only on the common leader electrode 103 and the individual leader electrodes 104. Next, Photonies (trade name of Toray K. K.) was coated, a window was opened on the heater 102, and thru-holes were opened at similar places as in the layer 108 of $SiO_2$ (see FIGS. 4A and 4B).

Figure 5:
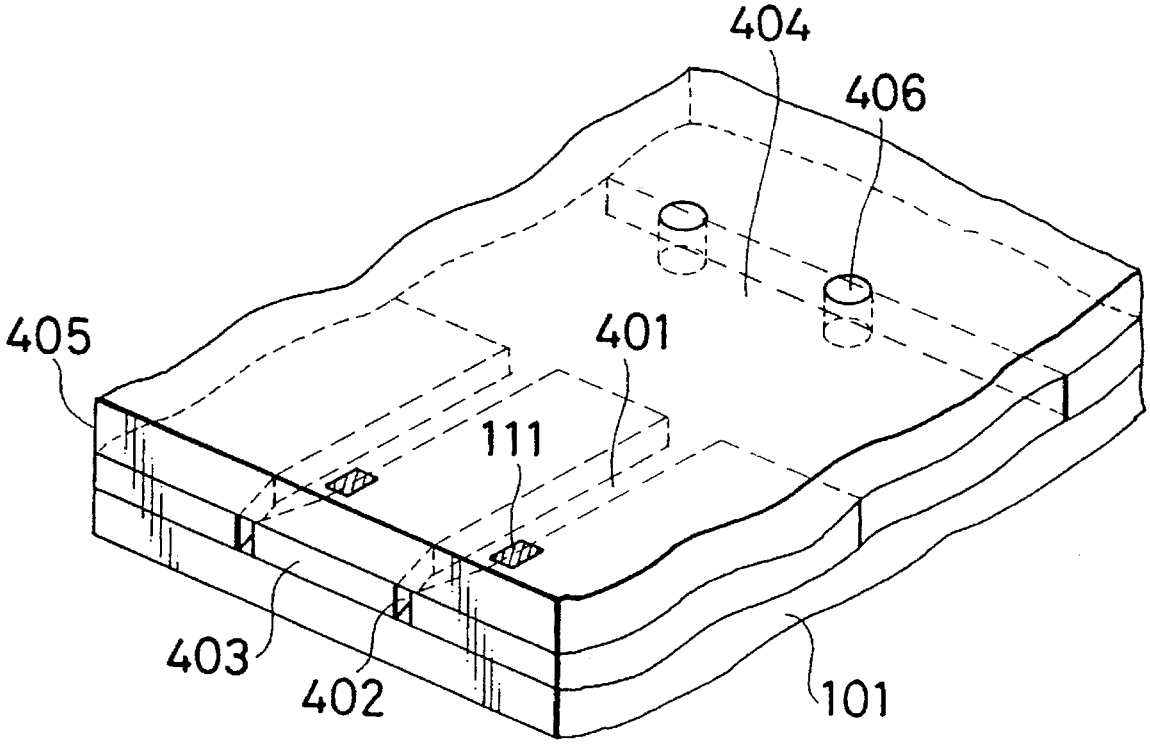
FIG. 5 is a partial perspective view of the recording head of an example of the present invention.

Next, to form the electrode of the second layer (not shown), Al was deposited and patterning was effected so as to leave only the common electrode portion. Next, discharge ports were formed as shown in FIG. 5 to complete the recording head. In FIG. 5, 401 is liquid path, 402 discharge port, 403 ink path wall which is the wall of the path 401,404 common liquid chamber, 405 ceiling, and 406 ink feeding inlet.

C. Experimental results

When the foaming voltage and the resistance value of the heater 102 of the recording head obtained by manufacturing by use of the photomask of which the mask design was performed as shown in FIG. 3 were measured, the results as shown in the following Table 1 were obtained.

TABLE 1

| Distance from A4 end surface (mm) | Total resistance (Ω) | Foaming voltage (V) |
|---|---|---|
| 0 | 106 | 10.4 |
| 50 | 106 | 10.3 |
| 100 | 105 | 10.5 |
| 150 | 106 | 10.3 |
| 200 | 105 | 10.4 |

As can be seen from Table 1, both resistance values and foaming voltages became substantially constant.

In contrast, in comparison with the present example, in the heater 102 of which the mask was designed by the fixed dimensions of the heater 102 of 20 μm×100 μm, without the mask design as shown in FIG. 3, the results of its foaming voltages and resistance values became as shown in the following Table 2.

TABLE 2

| Distance from A4 end surface (mm) | Total resistance (Ω) | Foaming voltage (V) |
|---|---|---|
| 0 | 80 | 9.8 |
| 50 | 97 | 10.3 |
| 100 | 105 | 10.5 |
| 150 | 97 | 10.3 |
| 200 | 80 | 9.7 |

Thus, in the comparative example using the prior art, foaming voltages were varied from 9.7 to 10.5 V.

When the recording head of the present example obtained by designing as shown in FIG. 3 was driven with a driving voltage of 10.4 V×1.2≈12.5 V, good printing results were obtained with A4 width. Also, since the driving voltage becomes 1.2-fold of the foaming voltage for any segment, good printing characteristics were obtained, and discharge durability was also good.

As compared with this, in the above comparative example, when the recording head is driven with a driving voltage of 12.6 V which is 1.2-fold of the maximum value 10.5 V of the foaming voltage (see Table 2), a segment with poor discharging durability appeared with the voltage becoming 1.3-fold of the minimum value 9.7 V of the foaming voltage. In the case of a driving voltage which is 1.3-fold of the foaming voltage, the pulse number was worsened by one cipher or more as compared with the 1.2-fold driving voltage. Thus, although the pulse durability of the central segment is good to be persistent for a long time, the segments on both ends became worse by one cipher or more than the central segment. When driven with 11.6 V which is 1.2-fold of the minimum value 9.7 V of the foaming voltage (see Table 2), the central portion of the maximum value of the foaming voltage became 1.1-fold, the printing quality was lowered to prevent good printing. This is because, for the segment at the central portion, 11.6 V of the driving voltage is 1.1-fold of the foaming voltage, whereby the foaming stability was worsened. Thus, in comparative example of the prior art, wherein the foaming voltage has a distribution, printing characteristic and discharging durability are varied and a tendency appears that the characteristics of a part of the segment group are worsened.

In the first place, determination of the multiple of the foaming voltage at which the head should be driven depends on printing characteristic and durability, and the optimum values of printing characteristics, etc. are within the permissible ranges of about 0.05-fold of the standard values. Therefore, if the foaming voltage is varied by 10% or more, adverse effects will appear in the printing characteristic and durability of the recording head. Particularly, in the full-multi integration type liquid jet recording head of A4 width or A3 width, due to the restriction of the thin film forming device, layer thickness distribution, namely the sheet resistance distribution (variation) is Generated, whereby the foaming voltage is distributed (varied) within the recording head. Accordingly, it becomes necessary to make the foaming voltage constant by varying the design dimensions of the heater corresponding to the change in the sheet resistance distribution as in the present example.

D. Other examples

In the present example described above, the case of having two upper protective layers 108, 110 on the heater was shown, but the present invention is of course applicable to a liquid jet recording head having no upper protective layer. Also, the shape of the heater need not be rectangular, but the pattern may be designed so that the resistance of the heater, the heater area may be the same.

Figure 6:
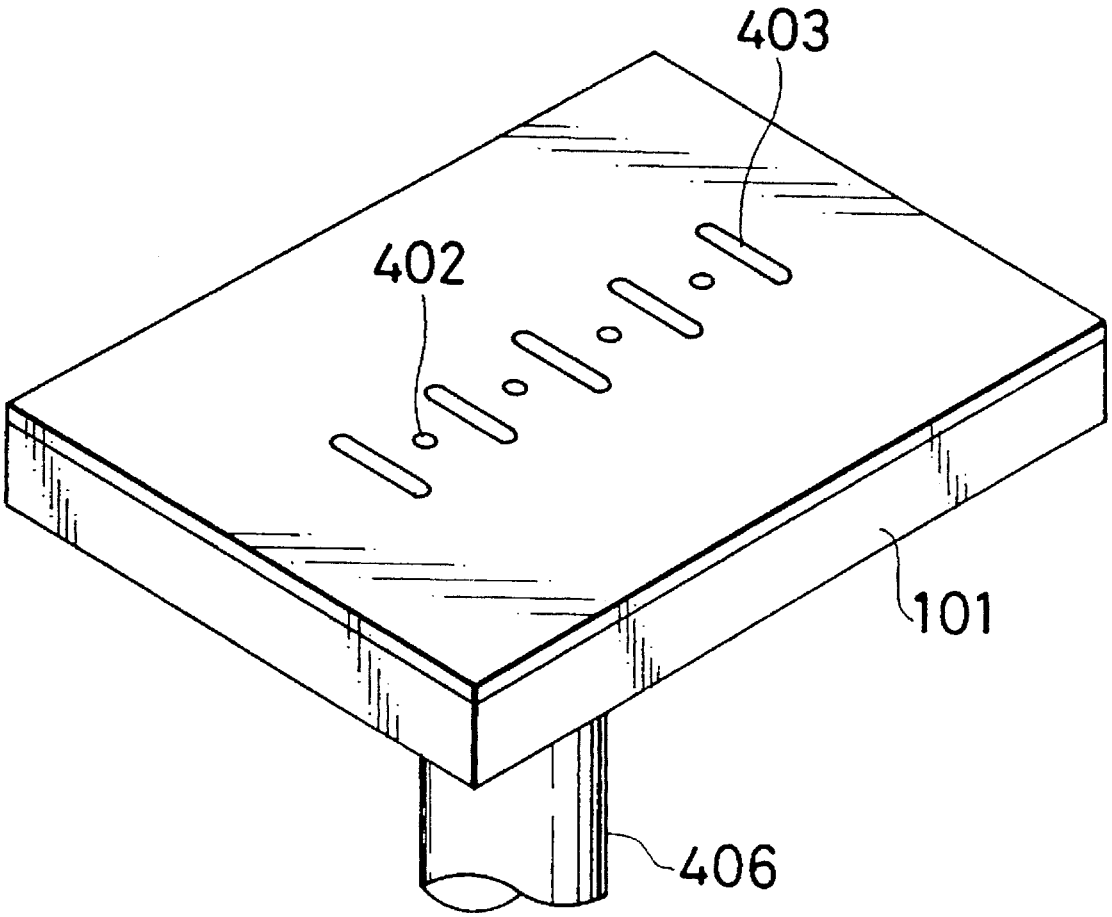
FIG. 6 is a constitutional illustration of the recording head of another example of the present invention.
Figure 7:
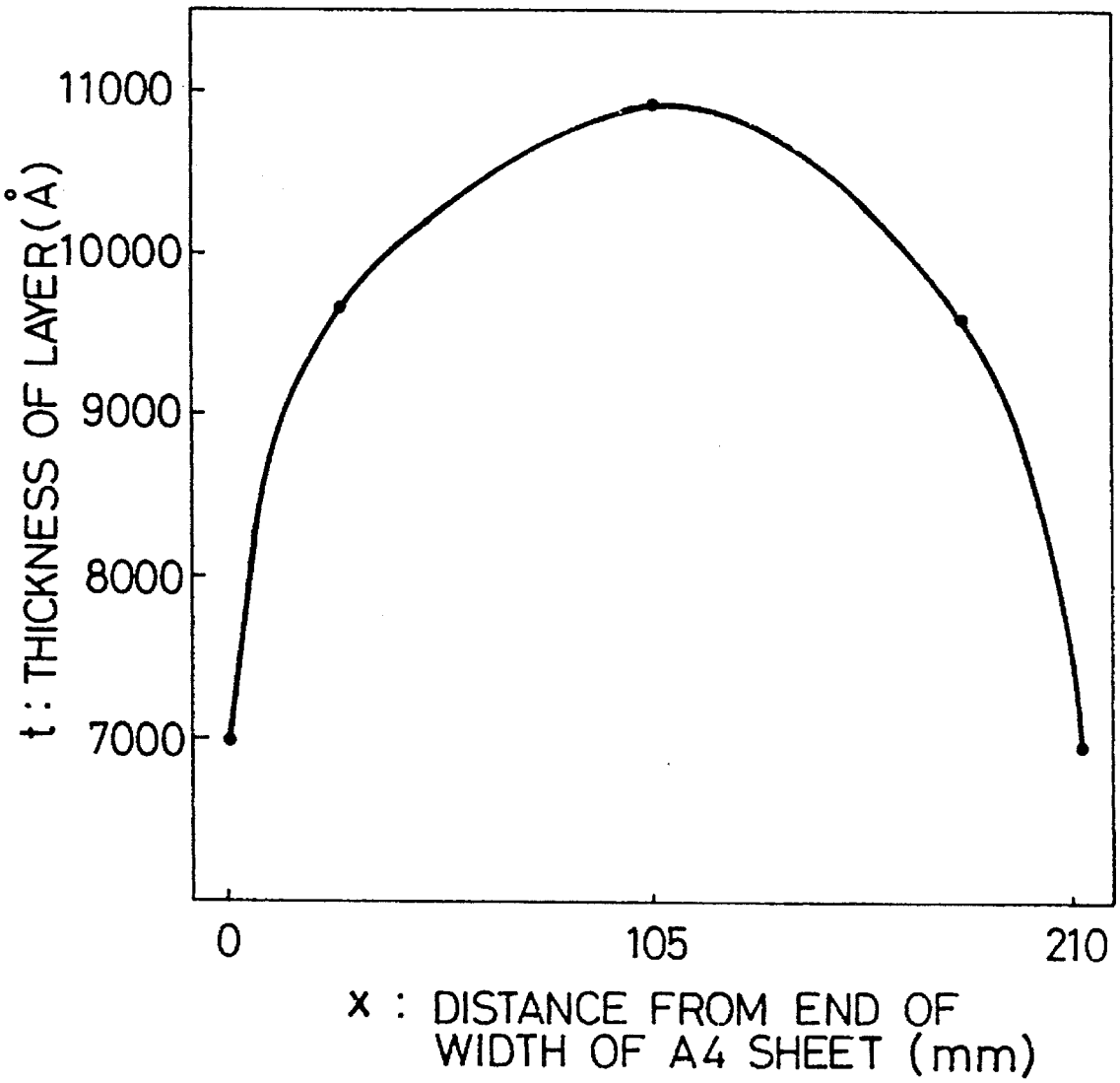
FIG. 7 is an illustration of still another example of the present invention.

In the present example as described above, the discharge direction of the recording liquid was in the plane direction of the heater (see FIG. 5), but the present invention is also applicable to the liquid jet recording head of the type which discharges recording liquid in the vertical direction to the heater as shown in FIG. 6.

As described above, according to the present invention, since the heat-generating portions have been formed by varying the dimensions of a plurality of heat-generating portions so that the resistance values may be substantially equal to each other according to the sheet resistances of the heat-generating portions of the heat-generating resistance layer, a full-multi integration type liquid jet recording head of A4 width, A3 width, etc. having good pulse durability as well as good print quality can be prepared by using of an inexpensive film forming device, whereby quality improvement along with reduction in production cost of the recording head can be realized.

A1. The second basic principle of the invention

Before explaining specific examples of the present invention, the basic principle of the present invention is to be described in detail.

The problems associated with prior art example can be solved, if the recording head is prepared by pattern designing with various dimensions of the heat-generating portion (heater) chosen so that the foaming voltages may be substantially equal to each other corresponding to the distribution characteristic of the layer thickness (layer thickness data) of the upper protective layer (hereinafter abbreviated as upper layer).

To describe in detail below, in a full-multi integration type liquid jet recording head, when the film thickness of the upper layer at both ends and the central portion are different, for example, with required power for foaming (heat-generating energy) of 0.8 at the central portion relative to 1 at both ends, the resistance values of the heat-generating portion (heater) may be designed at 0.8 : 1 of both ends : central portion corresponding to the change in layer thickness. However, the point of care in designing of the heat-generating portion is the area of the heat-generating portion. More specifically, in a recording head of the bubble jet recording system which discharges ink by generation of bubbles with heat, the area of the heat-generating portion becomes an important factor in bubble generation. The size of the area, affects the foaming volume, and therefore if the area is made smaller, the foaming volume becomes smaller, while if it is made larger, the foaming volume becomes larger. On the other hand, since the discharge volume of ink depends greatly on the foaming volume, the discharge volume will vary with on variation of the area of the heat-generating portion. Accordingly, printing quality is greatly concerned with uniformity of discharge volume, and therefore it is important to make the area of the heat-generating portion uniform as a whole.

By designing the heat-generating portion as described above, the heaters at the central portion and both ends have the same foaming voltages. Thus, because the heat-generating portions of the central portion and both ends have the same area and the same foaming voltage, by setting adequate driving voltage values with good pulse durability as well as good printing characteristic, all the segments from the central portion to both ends can be driven under the same conditions. Thus, it is possible to prepare a recording head with all segments having uniform performance particularly the balance of printing characteristic/durability.

Having described above the layer thicknesses of the upper layer at the central portion and both ends, it is practically necessary to vary the design pattern of the heat-generating portion according to the distribution of the whole distribution (change) of the layer thickness. Next, layer thickness distribution of the upper layer and design of dimensions of the heat-generating portion (hereinafter called heater) are described. For brevity of explanation, the heater is made rectangular.

First, the layer thickness distribution of the upper layer can be expressed as a function f(x) of the distance x from either one end of the sheet as the original point.

Now, if the dimension in the longer direction of the heater is defined as l, the dimension in the shorter direction as m, and the sheet resistance of the heater as R, the heater resistance h is expressed by the following formula (1):

$$h=R\times l/m \tag{1}$$

If the area of the heater is defined as s, s is represented by the following formula:

$$s=l\times m \tag{2}$$

If the layer thickness dependency of the upper layer on the foaming initiation power ($W_B$) is defined as g(t), g(t) is represented by the following formula (3). t is defined as the layer thickness (film thickness).

$$W_{B=g}(t) \tag{3}$$

g(t) is determined by experiments. When the foaming voltage is defined as $V_B$, the following formula (4) is valid:

$$W_B=\frac{V_B^2}{h} \tag{4}$$

$$V_B=\sqrt{W_B\times h}$$

From the formulae (1), (3) and (4), the following formula (5) is obtained.

$$\frac{l}{m}=\frac{V_B^2}{R\times g(t)} \tag{5}$$

Since l=s/m from the above formula (2), the following formula (6) is obtained from the above formula (5):

$$\frac{\frac{s}{m}}{m}=\frac{V_B^2}{R\times g(t)} \tag{6}$$

$$\frac{s}{m^2}=\frac{V_B^2}{R\times g(t)}$$

To rewrite the above formula (6) with respect to $V_B$, the following formula (7) is obtained.

$$V_B=\sqrt{\frac{S\times g(t)\times R}{m^2}} \tag{7}$$

(where S, R are constant)

Therefore, it can be understood from the formula (7) that $g(t)/m^2$ may be made constant for making the foaming voltage $V_B$ constant.

In other words, since there is the relationship of m=K x $\sqrt{g(t)}$ (where K is a constant value), the lateral dimension m of the heater can be designed from the experimental data of the layer thickness dependency g(t) of the foaming initiation power.

Specific examples are examples described below.

E. Third example

Description is made by referring to the constitution shown in in FIG. 4A, 4B. A heat-generating resistance layer 107 of $HfB_2$ is formed on silicon support 101 (also called glass substrate) by RF (high frequency) sputtering. In this case, the layer thickness of the heat-generating layer 107 is made 1000 Å, the sheet resistance 20Ω. On the heat-generating resistance layer 107 aluminum was vapor deposited a thickness of 5000 Å as the electrode materials 103, 104. Next, using the photolithographic technique by use of a photomask, a rectangular heater (heat-generating portion) 102 is formed (see FIG. 1). The photomask used at this time is described below.

Next, as the first upper protective layer 108, $SiO_2$ (silicon oxide) was prepared by RF sputtering. When the layer thickness distribution of the $SiO_2$ 108 was measured, as shown in FIG. 2, a tendency was exhibited that both ends are thin (7000 Å) and the central portion is thick (11000 Å) with A4 width.

Further, for the second protective layer 110, a Ta (tantalum) film was formed with a thickness of 5000 Å, and then was subjected to patterning by the photolithographic technique only around the heater 102, and $SiO_2$ layer 108 was subjected to patterning by opening thru-holes only on the common leader electrode 103 and the individual leader electrodes 104. Next, Photonies (trade name of Toray K. K.) was coated, a window was opened on the heater 102, and thru-holes were opened at similar places as in the layer 108 of $SiO_2$ (see FIG. 4).

Next, to form the electrode of the second layer (not shown), Al was deposited and patterning was effected so as to leave only the common electrode portion. Next, discharge ports were formed as shown in FIG. 5 to complete the recording head. In FIG. 5, 401 is liquid path, 402 discharge port, 403 ink path wall which is the wall of the path 401, 404 common liquid chamber, 405 ceiling, and 406 ink feeding inlet.

Next, the design of the photomask for forming the heater 102 is described.

The layer thickness dependency of the foaming power per unit area of the upper layer 108 of $SiO_2$, the foaming power Δp per unit area and the layer thickness t were found to be proportional to each other, according to the following formula (8):

$$\frac{\Delta p}{\Delta t} = 4.0 \times 10^{-1}\ \mathrm{W/mm^3} \quad (8)$$

When the thickness of the upper layer 108 of $SiO_2$ was 9000 Å, and the area of the heater 102 was 20 μm×100 μm, the foaming initiation power was found to be 0.8 W (watt). By substituting the numerical values of the layer thickness in the above formula (8), it can be understood that bubble initiation power of 0.88 W is obtained when the thickness of the upper layer 108 of $SiO_2$ is 11000 Å, 1nd the foaming initiation power is 0.72 W when the thickness of the layer 108 is 7000 Å.

From the above results, when calculation is performed with the voltage applied on the heater 102 being constant, the heater resistance of the heater 102 becomes 90Ω when the thickness of the upper layer 108 of $SiO_2$ is 11000 Å, while the heater resistance of the heater 102 becomes 110Ω, when the thickness of the upper layer 108 of $SiO_2$ is 7000 Å. By calculation with the area of the heater 102 being constant, the area of the heater 102 becomes 21 μm×95 μm when the thickness of the upper layer 108 of $SiO_2$ is 11000 Å, while the area of the heater 102 becomes 19 μm×105 μm when the thickness of the upper layer 106 of $SiO_2$is 7000 Å. The results thus calculated are shown in FIG. 3.

F. Experimental results

Figure 8:
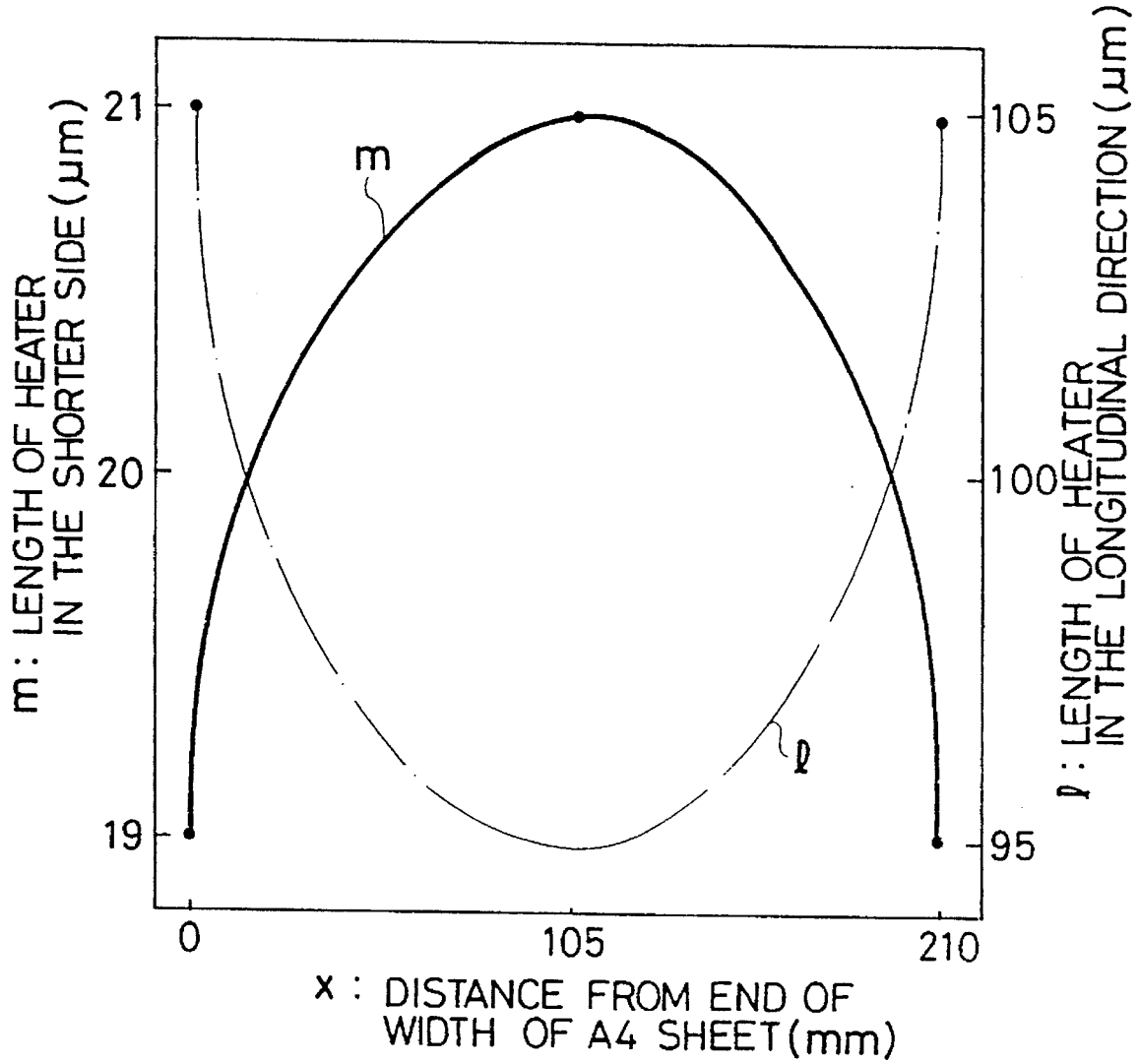
FIG. 8 is an illustration of another heater design dimensions of the present invention.

When the foaming voltage and the resistance value of the heater 102 including the protective layer obtained by manufacturing using of the photomask of which the mask design was performed as shown in FIG. 8 were measured, the results shown in the following Table 3 were obtained.

TABLE 3

| Distance from A4 end surface (mm) | Total resistance (Ω) | Foaming voltage (V) |
|---|---|---|
| 0 | 115 | 9.4 V |
| 50 | 100 | 9.5 V |
| 100 | 95 | 9.4 V |
| 150 | 100 | 9.4 V |
| 200 | 115 | 9.5 V |

As can be seen from Table 3, foaming voltages became substantially constant.

In contrast, as a comparative example in the heater 102 including the protective layer of which the mask was designed by the fixed dimensions of the heater 102 of 20 μm×100 μm, without the mask design as shown in FIG. 8, results of its foaming voltages and resistance values are shown in the following Table 4.

TABLE 4

| Distance from A4 end surface (mm) | Total resistance (Ω) | Foaming voltage (V) |
|---|---|---|
| 0 | 105 | 9.0 V |
| 50 | 106 | 9.7 V |
| 100 | 105 | 9.9 V |
| 150 | 105 | 9.6 V |
| 200 | 106 | 9.1 V |

Thus, in the comparative example according to the prior art, foaming voltages varied from 9.0 to 9.9 V.

When the recording head of the present Example obtained by designing as shown in FIG. 8 was driven with a driving voltage of 9.5 V×1.2≈11.4 V, good printing results were obtained with A4 width. Also, since the driving voltage can be made 1.2-fold of the foaming voltage for any segment, bubble formation by film boiling can be stabilized. Therefore, according to the present example, good printing characteristics were obtained, and discharging durability was good.

As compared with this, in the above comparative example, when the recording head is driven with a driving voltage of 11.9 V which is 1.2-fold of the maximum value 9.9 V of the foaming voltage (see Table 4), a segment with poor discharging durability appeared. This segment with poor discharging durability appeared at both ends with low foaming voltages. That is, since the driving voltage 11.9 V for those poor segments becomes 1.3-fold or more of the foaming voltage, it can be understood the durability is worsened. On the other hand, when driven at 10.8 V which is 1.2-fold of the minimum value 9.0 V of the foaming voltage (see Table 4), the printing printing quality at the central portion was lowered. Since 10.8 V of the driving voltage is 1.1-fold or lower of the foaming voltage of the segment of the central portion, it can be understood to be a bad printing region. Thus, in the comparative example according to the prior art, since the foaming voltage has a distribution, printing characteristic and discharging durability are varied, whereby a part of the segment group tends to become worsened.

In the first place, the fold voltage of the foaming voltage at which the head should be driven depends on printing characteristic and durability, and the optimum values of printing characteristics, etc. are within the permissible ranges of about 0.05-fold of the standard values. Therefore, if the foaming voltage is varied by 10% or more, adverse effects will appear in the printing characteristic and durability of the recording head. Particularly, in the full-multi integration type liquid jet recording head of A4 width or A3 width due to the limitations of the thin film forming device, layer thickness distribution, namely the sheet resistance distribution (variation) is generated, whereby the foaming voltage is distributed (varied) within the recording head. Accordingly, it becomes necessary to make the foaming voltage constant by varying the design dimensions of the heater corresponding to the change in the sheet resistance distribution as in the present example.

G. Other examples

In the present example described above, two layers 108, 110 of upper protective layers on the heater were shown, but the present invention is of course applicable wherein the upper protective layer has further layers. In that case, the characteristics of the respective films for the foaming power may be determined, and the heater mask may be designed by determining the foaming power at that place by the addition calculation method.

In the example described above, the discharge direction of the recording liquid was in the plane direction of the heater (see FIG. 5), but the present invention is also applicable to the liquid jet recording head of the type which discharges recording liquid in the vertical direction relative to the heater as shown in FIG. 6.

As described above, according to the present invention, since the heat-generating portions have been formed by varying their dimensions so that the foaming voltages may be substantially equal to each other in every segment corresponding to the layer thickness distribution (layer thickness change) of the upper layer formed on the electrothermal transducer, a full-multi integration type liquid jet recording head of A4 width, A3 width, etc. having good pulse durability as well as good printing quality can be prepared by using of an inexpensive film forming device, whereby quality improvement along with reduction in production cost of the recording head can be effected.

Figure 9:
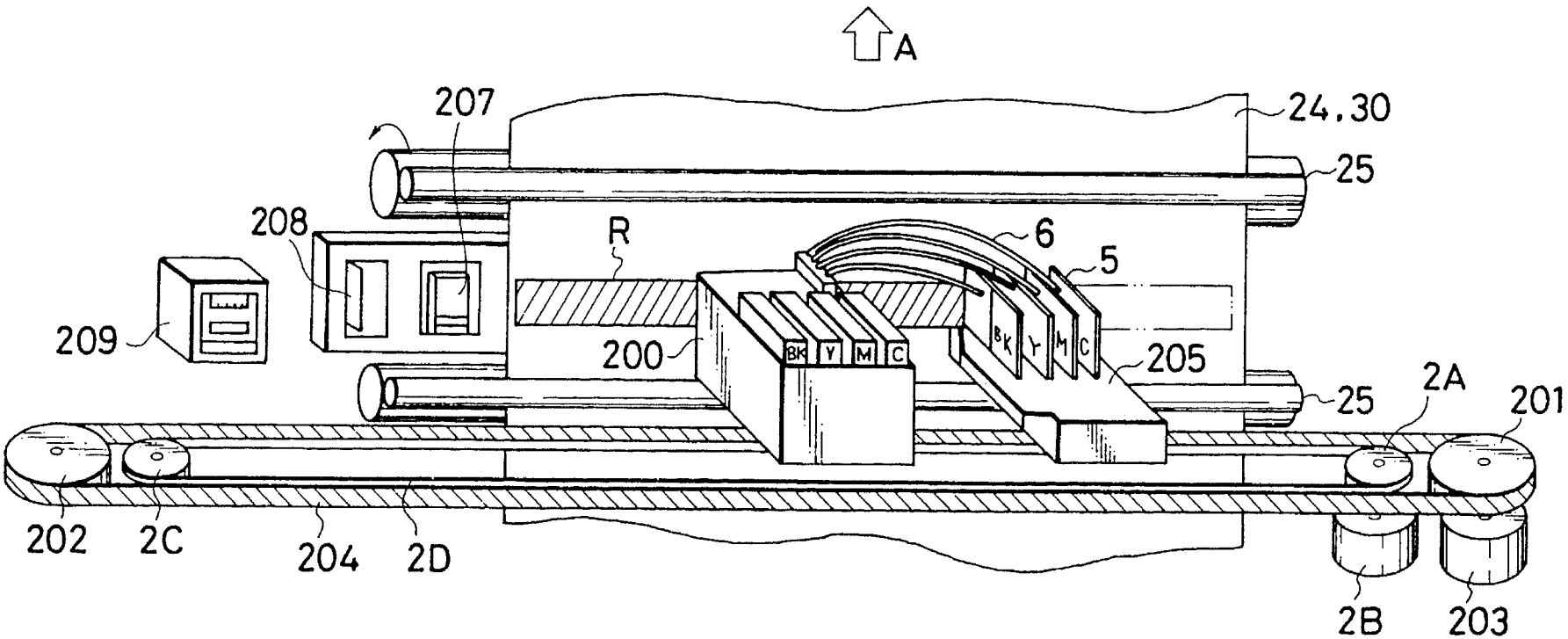
FIG. 9, FIGS. 10A and 10B are each illustration of the recording apparatus of the present invention.

FIG. 3 is a diagram showing an example of the heater design dimensions, and FIG. 9 is a constitutional diagram of pertinent portions of a serial color printer to which the recording head of the present invention is applied. The arrowhead A is the delivery direction of the conveying means 25, 25 which convey the cut sheet 24 or the roll sheet 30 as the recording medium, and this example moves the recording head 5 with the pulley 2A which synchronizes the carriage 205 for mounting four of cyan C, magenta M, yellow Y, black BK with the pulse motor 2B, the driving belt 2D wound therearound and the pulley 2C at the other end region. Also, the carriage 200 has ink tanks for supplying inks to these recording heads 5 mounted thereon and is moved by the belt 204 wound over the pulleys 201, 202 and the motor 203 for driving the pulley 201.

These constitutions are burdens on the motor 203 exhibiting sufficient driving force, which is not of high precision because of the weight of the ink carriage 200, while on the other hand the recording head carriage 205 which is based on a premise of high precision is made lightweight and driven by the pulse motor 2B, and the carriage 200 moves following the carriage 205 at a distance not so greatly apart therefrom but without contact therewith. 207 is an absorbing member (paper or sponge) for absorbing ink of blank discharge, and is as fixed at a predetermined position together with the head cleaning blade 208. 209 is a known recording head cap, which prevents evaporation of ink by capping the recording head during non-recording period, and a negative pressure is given thereto, if necessary, by a suction pump not shown.

R is a color printing region, and since the four recording heads are stabilized with the above-mentioned recording heads, sufficient densities can be obtained also at the boundaries between the regions R, and therefore the density balance of full color becomes highly precise, whereby pitch irregularity can be prevented. This example is color mode, but also good printing can be performed in monochromatic mode as a matter of course.

Figure 10A:
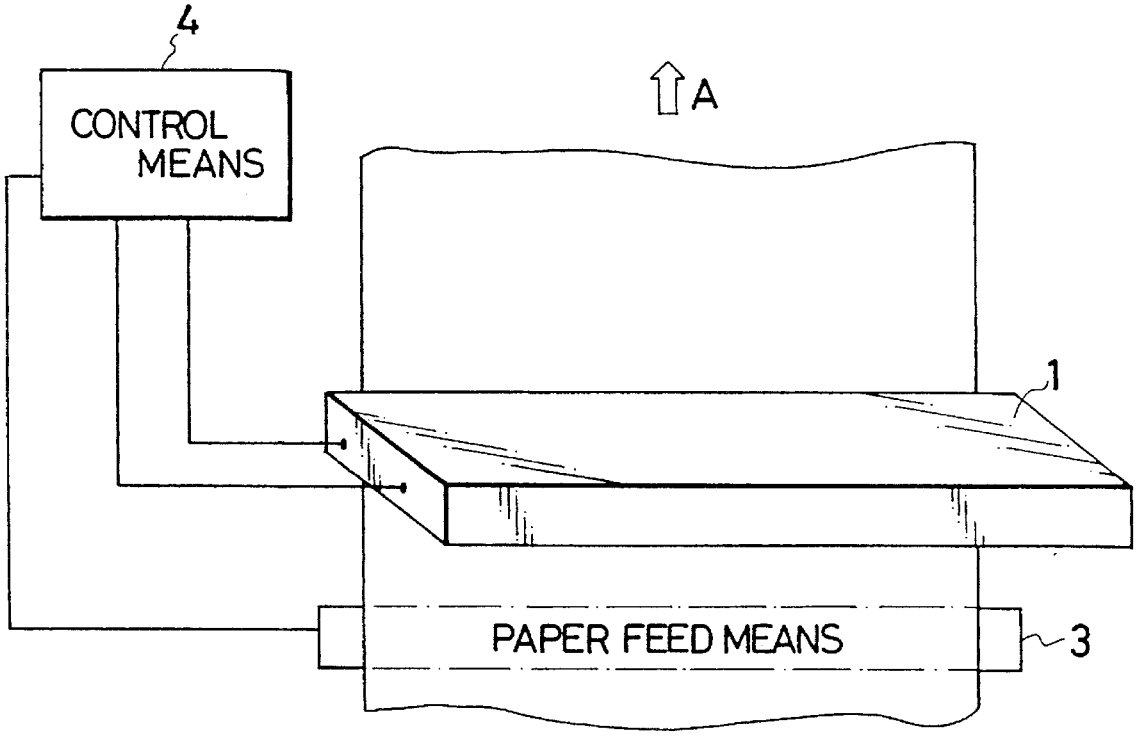
Figure 10B:
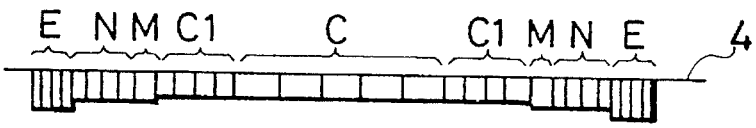

FIG. 10A shows application of the full-line head 1 of the recording head of the present invention to a recording apparatus, and 3 is a paper delivery means as the conveying means of the recording medium, and paper delivery is performed by the control means 4 corresponding to recording with the recording head 1. Ordinarily, paper delivery is performed continuously. By doing so, good printing without recording irregularity over the entire width can be effected. FIG. 10B shows a resistor shape for the heat-generating portion of the heater. In this FIG. 10A, along the standard L on the discharge port side, the length is varied toward the ink supplying side, with the lengths at both ends E, both end sides N, the intermediate portion n, the central region C1, the center C being reduced in this order (C, C1 are the same, M, N are the same). Their widths are greater in the order of E, N, M, C1, C, with the respective resistance values indicating the tendency for becoming constant. This example shows stepwise variations instead of the continuous variation in the above Figure, which is also included within the present invention.

The present invention brings about excellent effects particularly in a recording head, a recording apparatus of the bubble jet system among the ink jet recording systems.

As for its representative constitution and principle, for example, those using the basic principles disclosed in U.S. Pat. Nos. 4,723,129 and 4,740,796 are preferred. This system is applicable to either the so called on-demand type or the continuous type. However, particularly in the case of the on-demand type, by applying at least one driving signal which gives quick temperature elevation in excess of nuclear boiling corresponding to the recording information to an electrothermal transducer arranged corresponding to the sheet or the liquid path where a liquid (ink) is held, heat energy is generated at the electrothermal transducer to effect film boiling at the heat acting surface of the recording head, thereby consequently effectively forming bubbles within the liquid (ink) corresponding to the driving signal. By growth and shrinkage of such bubbles, the liquid (ink) is discharged through openings for discharge, to form at least one droplet. When the driving signal is made in pulse shape, growth and shrinkage can be effected instantly and adequately, whereby discharging of liquid (ink) particularly excellent in response characteristic can be more preferably accomplished. As the driving signal shaped in such pulse shape, those described in U.S. Pat. Nos. 4,465,359 and 4,345,262 are suitable. Further excellent recording can be effected by employment of the conditions described in U.S. Pat. No. 4,313,124 which is the invention concerning the temperature elevation rate of the above heat acting surface.

As the constitution of the recording head, in addition to the combined constitution of discharge port, liquid path, electrothermal transducer (linear liquid path or right angle liquid path), the constitutions by use of U.S. Pat. Nos. 4,558,333 and 4,459,600 disclosing the constitution wherein the heat acting portion is arranged in flexed region are also included in the present invention. Additionally, the present invention is also effective if the constitution may be made on the basis of Japanese Laid-open Patent Application No. 59-123670 disclosing the constitution with a slit common to a plurality of electrothermal transducers as the discharge portion of the electrothermal transducers or Japanese Laid-open Patent Application No. 59-138461 disclosing the constitution in which openings absorbing pressure wave heat energy are made correspondent to the discharge portion.

Further, as the recording head of the full-line type having a length corresponding to the maximum width of the recording medium which can be recorded with the recording device, either a constitution satisfying its length or a constitution formed integrally as one recording head according to the combination of the plurality of recording heads as disclosed in the above-mentioned specifications, but the present invention can exhibit the effects as described above further effectively.

In addition, the present invention is also effective for a recording head of the freely interchangeable chip type, which enables electrical connection to the main device and supply of ink from the main device by being mounted on the main device, or the case by use of a recording head of the cartridge type integrally provided on the recording head itself.

Also, addition of a restoration means, a preliminary auxiliary means of the recording head provided as the constitution of the recording apparatus of the present invention is preferable, because the effects of the present invention can be further stabilized thereby. To mention these in more detail, capping means, cleaning means, pressurization or suction means, pre-heating means with an electrothermal transducer, another heating element different from this or a combination of these, and practice of preliminary discharge mode which performs discharge separately from recording are also effective for performing stable recording.

Further, as the recording mode of the recording apparatus, the present invention is effective not only for the recording mode of the main color alone such as black, etc., but also for the device equipped with plural colors or at least one of full-color by color mixing, either by way of integrated constitution of recording heads or a combination of plural recording heads.

In the examples of the present invention as described above, ink is described as liquid, but even an ink which is solidified at room temperature or lower may be employed, provided that it is liquid when used for recording, since it is Generally practiced to control the viscosity of the ink by temperature control under stable discharge range, which is softened or liquid at room temperature, or by temperature control of the ink itself within the range of 30° C. to 70° C. in the ink jet as described above. In addition, use of an ink having the property which is for the first time liquefied by heat energy is also applicable to the present invention, such as one in which temperature elevation of heat energy is positively prevented by using it as the energy for the state change from the solid state to the liquid state, or which is solidified under the state left to stand for the purpose of preventing evaporation of ink, anyway one which is discharged as ink liquid by liquification of ink by imparting heat energy corresponding to signals or one which already begins to be solidified when reaching the recording medium, etc. In such case, the ink may be made the state held as the liquid or solid product in concavities or thru-holes of a porous sheet, and in the form opposed to the electrothermal transducer, as described in Japanese Laid-open Patent Application No. 54-56847 or Japanese Laid-open Patent Application No. 60-71260. In the present invention, the most effective of the respective inks described is one which implements the film boiling system as described above.

What is claimed is:

1. A method for manufacturing a substrate for a liquid jet recording head having a plurality of heat generating resistance elements each for generating thermal energy to discharge a liquid droplet, each said heat generating resistance element having a resistance value, comprising the steps of:

preparing a substrate;

forming, on said substrate, a film from which said heat generating resistance elements are formed;

measuring a distribution of a thickness of the film from which said heat generating resistance elements are formed;

forming a mask on which a plurality of different patterns for preparing said heat generating resistance elements are arranged, so that the resistance values of said heat generating resistance elements are substantially the same in accordance with the distribution of the thickness of the film; and etching said film from which said heat generating resistance elements are formed using said mask to form said plurality of different patterns for said heat generating resistance elements on said substrate, wherein said different patterns for said heat generating resistance elements all have substantially a same area.

2. A process according to claim 1, further comprising the step of producing a plurality of liquid paths on said substrate, wherein said plurality of liquid paths communicate with a plurality of discharge ports for discharging a liquid and correspond to a plurality of heat-generating portions for generating heat energy for discharging the liquid, and wherein said plurality of liquid paths are produced in said producing step so as to provide a plurality of recording heads on said substrate.

3. A process according to claim 1, wherein said plurality of electrothermal transducers are formed so that said electrothermal transducers have a stepwise variation in size.

4. A method for manufacturing a substrate for a liquid jet recording head having a plurality of heat generating resistance elements each for generating thermal energy to discharge a liquid droplet, and a protective layer for protecting said heat generating resistance elements, and having a heat generating portion on each said heat generating resistance element, comprising the steps of:

preparing a substrate;

preliminarily measuring a distribution of a thickness of a protective layer when said protective layer is formed as a film on said substrate;

forming, on said substrate, a film from which said heat generating resistance elements are formed;

measuring a distribution of a thickness of the film from which said heat generating resistance elements are formed;

forming a mask on which a plurality of different patterns for said heat generating resistance elements are arranged so that a foaming power of each said heat generating portion is substantially the same in accordance with the distribution of the thickness of said protective layer and the distribution of the thickness of said heat generating resistance elements;

etching said film from which said heat generating resistance elements are formed using said mask to form said plurality of different patterns for said heat generating resistance elements on said substrate; and forming said protective layer on said heat generating resistance elements;

wherein said different patterns for said heat generating resistance elements all have substantially a same area.

5. A process according to claim 4, further comprising the step of producing a plurality of liquid paths on said substrate, wherein said plurality of liquid paths communicate with a plurality of discharge ports for discharging a liquid and correspond to a plurality of heat-generating portions for generating heat energy for discharging the liquid, and wherein said plurality of liquid paths are produced in said producing step so as to provide a plurality of recording heads on said substrate.

6. A process according to claim 5, wherein said plurality of electrothermal transducers are formed so that said electrothermal transducers have a stepwise variation in size.

7. A process according to any of claims 1 or 2–6, further comprising a step of patterning said film from which said heat generating resistance elements are formed so that a heat-generating resistance layer comprises a portion of that said film.

8. A process according to any of claims 1 or 2–6, wherein each said heat-generating portion defined in said forming step has different dimensions according to the distribution of the thickness of the film from which said heat generating resistance elements are formed.

9. A process according to claim 8, further comprising a step of patterning said film from which said heat generating resistance elements are formed so that a heat-generating resistance layer comprises a portion of that said film.

* * * * *

UNITED STATES PATENT AND TRADEMARK OFFICE

CERTIFICATE OF CORRECTION

PATENT NO. : 5,559,543

DATED : September 24, 1996

INVENTOR : HIROKAZU KOMURO

It is certified that error appears in the above-identified patent and that said Letters Patent is hereby corrected as shown below:

ON TITLE PAGE

[57] ABSTRACT

Line 2, "and," should read --, and --;
Line 5, "is" should read --is a--;
Line 11, "acing" should read --acting--.

COLUMN 1

Line 5, "1992" should read --1992, now--;
Line 7, "1991 abandoned" should read --1991, now abandoned,--;
Line 8 "1990" should read --1990, also--;
Line 15, "substrate" should read --substrate,--;
Line 38, "54-51837," should read --54-51837--;
Line 45, "charge" should read --change--.

COLUMN 2

Line 20, "insullating" should read --insulating--;
Line 26, "to" should read --to a--;
Line 57, "twenty-four," should read --twenty-four--, and "transducers" should read --transducers,--, and "no" should read --not--;

UNITED STATES PATENT AND TRADEMARK OFFICE

CERTIFICATE OF CORRECTION

PATENT NO. : 5,559,543

DATED : September 24, 1996

INVENTOR : HIROKAZU KOMURO

It is certified that error appears in the above-identified patent and that said Letters Patent is hereby corrected as shown below:

COLUMN 2 continued

Line 65, "in" should read --in the--;
Line 66, "head" should read --heads--.

COLUMN 3

Line 21, "of" should be deleted;
Line 37, "contrary," should read --contrary, when--;
Line 54, "printing," should read --printing--.

COLUMN 4

Line 5, "increase." should read --increases.--;
Line 14, "invention," should read --invention--.
Line 18, "compensated" should read --compensated for--;
Line 38, "charging" should read --changing--;
Line 44, "said" should read --the--;
Line 48, "for" should read --for a--, and
"head," should read --head--.

UNITED STATES PATENT AND TRADEMARK OFFICE

CERTIFICATE OF CORRECTION

PATENT NO. : 5,559,543

DATED : September 24, 1996

INVENTOR : HIROKAZU KOMURO

It is certified that error appears in the above-identified patent and that said Letters Patent is hereby corrected as shown below:

COLUMN 5

Line 50, "of" should read --of widths such as--.

COLUMN 6

Line 18, "another" should read --other--;
Line 20, "each" should read --each an--;
Line 34, "of liquid" should read --of a liquid--;
Line 41, "by" should be deleted.

COLUMN 7

Line 17, "both" should be deleted;
Line 25, "area," should read --area--;
Line 62, "area $_s$" should read --area s--.

COLUMN 8

Line 2, "derived" should read --derived:--;
Line 11, "m= s/h x f(x) . (4)" should read --m= s/h xf(x) (4).--;
Line 20, "$HfB_2$is" should read --$HfB_2$ is--;

UNITED STATES PATENT AND TRADEMARK OFFICE

CERTIFICATE OF CORRECTION

PATENT NO. : 5,559,543

DATED : September 24, 1996

INVENTOR : HIROKAZU KOMURO

It is certified that error appears in the above-identified patent and that said Letters Patent is hereby corrected as shown below:

COLUMN 8 continued

Line 32, "as" should read --as measured--;
Line 44, "of" should be deleted;
Line 48, "oxide)" should read --dioxide)--, and "RF" should read --by RF--.

COLUMN 9

Line 59, "the" (2nd occurrence) should read --whereby the --;
Line 63, "in" should read --in the--.

COLUMN 10

Line 12, "Generated," should read --generated,--;
Line 40, "of" should be deleted;
Line 48, "with" should read --with the--.

COLUMN 11

Line 2, "area," should read --area--;

UNITED STATES PATENT AND TRADEMARK OFFICE

CERTIFICATE OF CORRECTION

PATENT NO. : 5,559,543

DATED : September 24, 1996

INVENTOR : HIROKAZU KOMURO

It is certified that error appears in the above-identified patent and that said Letters Patent is hereby corrected as shown below:

COLUMN 11 continued

Line 8, "on" should be deleted;
Line 22, "performance" should read --performance,--;
Line 52, "$W_{B=g}(t)$" should read --$W_B=g(t)$--.

COLUMN 12

Line 26, "in in FIG." should read --in FIGS.--;
Line 31, "deposited" should read --deposited to--.

COLUMN 13

Line 9, "1nd" should read --and--;
Line 22, "106" should read --108--;
Line 27, "of" (1st occurrence) should be deleted.

COLUMN 14

Line 13, "printing" (1st occurrence) should be deleted.

UNITED STATES PATENT AND TRADEMARK OFFICE

CERTIFICATE OF CORRECTION

PATENT NO. : 5,559,543

DATED : September 24, 1996

INVENTOR : HIROKAZU KOMURO

It is certified that error appears in the above-identified patent and that said Letters Patent is hereby corrected as shown below:

COLUMN 15

Line 7, "four of" should read --four recording heads of--.

COLUMN 16

Line 40, "specifications," should read --specifications may be included,--.

COLUMN 17

Line 5, "Generally" should read --generally--;
Line 15, "state" should read --state and--;
Line 16, "anyway" should be deleted;
Line 20, "the state held" should read --to hold its state--;
Line 53, "process" should read --method--.

COLUMN 18

Line 1, "process" should read --method--;
Line 31, "elements;" should read --elements,-;

UNITED STATES PATENT AND TRADEMARK OFFICE

CERTIFICATE OF CORRECTION

PATENT NO. : 5,559,543

DATED : September 24, 1996

INVENTOR : HIROKAZU KOMURO

It is certified that error appears in the above-identified patent and that said Letters Patent is hereby corrected as shown below:

COLUMN 18 continued

Line 34, "process" should read --method--;
Line 44, "process" should read --method--;
Line 47, "process" should read --method-- and "claims 1 or 2-6," should read --claims 1 to 6,--;
Line 52, "process" should read --method-- and "claims 1 or 2-6," should read --claims 1 to 6,--;
Line 57, "process" should read --method--.

Signed and Sealed this

Twenty-second Day of April, 1997

Bruce Lehman

*Attest:*

BRUCE LEHMAN

*Commissioner of Patents and Trademarks*

*Attesting Officer*